United States Patent [19]

Sunaga et al.

[11] 4,145,137

[45] Mar. 20, 1979

[54] ELECTROPHOTOGRAPHIC REPRODUCING MACHINE BLADE CLEANING APPARATUS

[75] Inventors: Ryuzoh Sunaga; Kunimi Hasegawa, both of Ebina, Japan

[73] Assignee: Rank Xerox Limited, London, England

[21] Appl. No.: 830,727

[22] Filed: Sep. 6, 1977

[30] Foreign Application Priority Data

Oct. 8, 1976 [JP] Japan ..... 51-134877

[51] Int. Cl.[2] ..... G03G 21/00

[52] U.S. Cl. ..... 355/15; 15/256.51; 118/652

[58] Field of Search ..... 355/15, 30 D; 15/256.5, 15/256.51, 256.53; 118/652; 198/497–499

[56] References Cited

U.S. PATENT DOCUMENTS

| | | | |
|---|---|---|---|
| 3,526,457 | 9/1970 | Diamond et al. | 15/256.51 X |
| 3,600,081 | 8/1971 | Egnaczak | 355/15 X |
| 3,819,263 | 6/1974 | Draugelis | 355/15 |
| 4,007,982 | 2/1977 | Stange | 15/256.53 X |

*Primary Examiner*—R. L. Moses

[57] ABSTRACT

A blade cleaning apparatus for an electrophotographic reproducing machine including a cleaning apparatus with a system for cyclically separating a doctor blade from an imaging surface, and a blade vibrator for applying vibration to the doctor blade when it is separated from the surface.

4 Claims, 3 Drawing Figures

ELECTROPHOTOGRAPHIC REPRODUCING MACHINE BLADE CLEANING APPARATUS

BACKGROUND OF THE INVENTION

This invention relates to a blade cleaning apparatus for a dry process electrophotographic reproducing (xerographic) machine. Generally, a xerographic machine reproduces images by a process that involves forming a latent image of a document on a revolving photoconductor drum which is coated with a film of photoconductive insulating material. In the development stage, the above-stated latent image is transformed into a visible image by the use of a toner composed mostly of powdered resin, with a coloring comprising carbon black powder and a developer composed of a carrier substance.

In the revolving photographic process, furthermore, the visible image colored by the toner is transferred onto an image support material such as paper. In the transfer step, not all of the toner particles are transferred and some residual particles remain on the photoconductor surface. These residual toner particles must be removed by means of a cleaning apparatus before proceeding on to the next copying cycle. After the residual toner particles are removed, the entire surface of the photoconductor is irradiated by a lamp and all electrical potential is discharged from the surface.

Cleaning apparatuses have, heretofore, consisted generally of a rotating brush made on rayon wool, or a doctor blade made of polyurethane sheeting. The advantages of the doctor blade cleaning apparatus over the rotating brush are that the former is more compact, operates on less electrical power, and does not require a vacuum structure.

Since the doctor blade directly scrapes off the residual toner from the photoconductor surface, it is easy for foreign matter to adversely affect the surface being scraped. In addition, not all the toner particles drop off from the doctor blade and there is a tendency for them to build up and accumulate in areas where the doctor blade comes into contact with the photoconductor surface. This phenomenon has the tendency to reduce the effectiveness of the cleaning, and the photoconductor surface tends to be damaged by foreign matter comprised mostly of the carrier substance and particles of paper powder. This creates poor cleaning, consequently decreasing the quality of copies reproduced.

SUMMARY OF THE INVENTION

This invention relates to the above-stated problem. The objective herein is to remove the residual toner and other foreign matter from the contact point of the doctor blade with the photoconductor drum. This is accomplished effectively without damaging the photoconductor drum and while insuring that high quality copies are reproduced.

In accordance with this invention residual toner and other foreign matter accumulated on the tip of a doctor blade cleaning apparatus are removed by vibration. A most effective cleaning result is maintained over a long period of time without damage to the doctor blade and the photoconductor drum while still insuring high quality copying results.

DETAILED DESCRIPTION OF THE INVENTION

Figure 1:
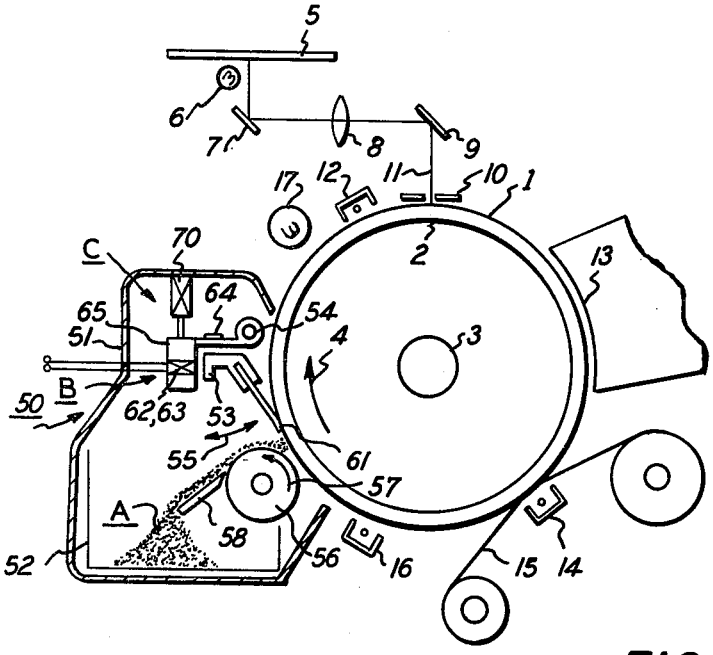
FIG. 1 is a vertical section schematic view of a xerographic machine equipped with the blade cleaning apparatus in accordance with one embodiment of this invention.
Figure 2:
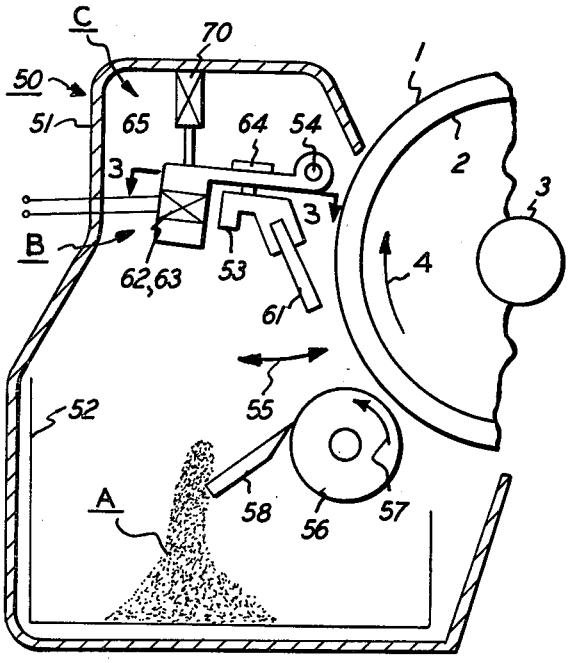
FIG. 2 is a vertical section schematic view of the of the apparatus of this invention in actual application.
Figure 3:
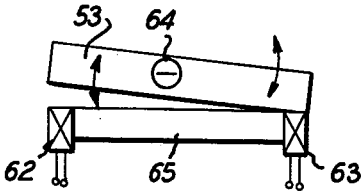
FIG. 3 is a vertical section schematic view of the apparatus along lines III to III.

The following details are in reference to the Figures provided for this invention. In FIGS. 1 and 2, the photoconductor drum 2 is coated with a film of a photoconductive insulating substance 1. The photoconductor drum 2 is centered on a shaft 3 and rotates in the direction of arrow 4. A document 5 to be copied or reproduced is irradiated by lamp 6 and an image thereof produced by the mirrors 7 and 9, and the lens 8 is projected through the exposure adjustment aperture 10 onto the drum surface 1.

The surface 1 is charged by corona generator (corotron) 12 and the latent image is developed at 13. The developed image is then transferred to the image support material 15 by corona generator (corotron) 14. The imaging surface 1 is then treated by a pre-clean corona generator (corotron) 16, and a lamp 17.

In the Figures, the cleaning apparatus 50 consists of a casing 51 and shaft 54 on which a solenoid support 65 swings in the direction of the arrow 55. On the solenoid support 65, a blade holder 53 is pivotally affixed by a pin 64 that enables the blade holder 53 to rotate. Doctor blade 61 is attached to blade holder 53. Solenoids 62 and 63 are attached on each end of the solenoid support 65, respectively. By magnetizing solenoids 62 and 63 alternately, it is possible to alternately thrust blade the holder 53 against the solenoid support 65. These collision impulses cause doctor blade 61 to vibrate, and are a result of the vibratory mechanism B.

The cleaning apparatus 50 is also equipped with a roller 56 which revolves in the direction of the arrow 57. Roller 56 is rubbed by scraper plate 58 which drops toner A into a toner receptacle 52.

The cleaning apparatus 50 is equipped with doctor blade 61 which is cyclically separated from photoconductor drum 2 by a drive mechanism C. This drive mechanism C consists of solenoid 70 affixed in casing 51. By sending electricity intermittently to solenoid 70, blade holder 53 swings back and forth in the direction of arrow 55 on the shaft 54 which acts as a fulcrum.

Blade vibration mechanism B and drive mechanism C are not limited to the above-described composition, however.

The operation of the apparatus is as follows: The photoconductor drum 2 is rotated in the direction of the arrow 4 and the entire surface is electrically charged by charge corotron 12. Document 5 is irradiated sequentially by lamp 6 and via mirror 7, lens 8, mirror 9, along ray axis 11, it is projected onto the photoconductor drum 2 whereby a latent image of the document-/material is formed.

The photoconductor drum 2 whereon the latent image of the document 5 is formed moves on to the development stage next. The developer 13 is equipped with proper developer apparatus and transforms the latent image into a visible image by adhesion of toner A. The visible image is then transferred onto the image support material (paper, etc.) 15 by the transfer corotron 14. The toner image is permanently fused on the image support material 15 by an appropriate fuser (not shown).

After the image is transferred, the photoconductor drum 2 is cleaned of residual toner. The pre-clean corotron, facilitates the removal of Toner A by the cleaning apparatus 50. The cleaning apparatus 50 completely removes all residual toner from the photoconductor drum 2.

The entire surface of the photoconductor drum 2 is then irradiated by lamp 17 and all residual electrical charges are discharged.

The pressure of the doctor blade 61 against the photoconductor drum 2 is adequate for scraping off toner A onto the roller 56. Toner A is thereafter placed into receptacle 52 by means of the scraper plate 58.

The copying (reproduction) cycle is thus complete and the xerographic machine stops. When the photoconductor drum 2 stops revolving, by action of the driving mechanism C, the blade holder 53 still maintaining doctor blade 61 will revolve clockwise on shaft 54, in the direction of the arrow 55, to separate it from the photoconductor drum 2.

Thereafter, by alternate magnetic induction of solenoids 62 and 63, blade holder 53 which is a magnetizable body is forced to vibrate on pin 64 at its center. The blade holder 53 is thereby forced to alternately collide with solenoid support 65, sending shock impulses to the doctor blade 61 which shake off the toner and other foreign particles clinging to it. The blade holder 53 with the tip of the doctor blade 63 cleaned is then forced to come into contact with photoconductor drum 2 by energizing the drive mechanism C for the next copying cycle.

It is apparent that there has been provided in accordance with this invention an electrophotographic reproducing machine blade cleaning apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a blade cleaning apparatus for removing residual material from a moving imaging surface of a reproducing machine, said apparatus comprising: a blade for engaging said surface to remove said material; means for supporting said blade for movement between a position wherein it is in operative engagement with said surface, and a position wherein it is separated from said surface; the improvement wherein, said apparatus further comprises:

means for vibrating said blade when it is separated from said surface for shaking off said residual material and foreign material from said blade.

2. An apparatus as in claim 1, wherein said blade support means includes a support member, a blade holder supported by said support member, and means for pivotably supporting said blade holder for movement about an axis extending longitudinally of said surface, and wherein said vibrating means comprises means for rocking said blade holder about said axis so that it alternately collides with said support member, whereby said blade is caused to vibrate to remove said materials.

3. An apparatus as in claim 2, wherein said support member is arranged for pivoting movement so as to pivotally support said blade holder and said blade for movement between said positions and wherein said means for moving said blade between said positions comprises a solenoid connected to said support member, which is operative to move said blade to said separated position upon the stopping of said imaging surface.

4. An apparatus as in claim 3, wherein said vibrating means further comprises a first solenoid and a second solenoid arranged at respective ends of said support member, and adjacent corresponding ends of said blade whereby alternate actuation of said first and second solenoids causes said blade holder to rock about said axis so that said ends of said blade alternately collide with said support member.

* * * * *